US010522109B2

(12) United States Patent
Mese et al.

(10) Patent No.: US 10,522,109 B2
(45) Date of Patent: Dec. 31, 2019

(54) ADJUSTING BRIGHTNESS SETTINGS BASED ON CONTEXT DATA

(71) Applicant: LENOVO (Singapore) PTE. LTD., New Tech Park (SG)

(72) Inventors: John Carl Mese, Cary, NC (US); Nathan J. Peterson, Oxford, NC (US); Russell Speight VanBlon, Raleigh, NC (US); Arnold S. Weksler, Raleigh, NC (US)

(73) Assignee: Lenovo (Singapore) PTE. LTD., New Tech Park (SG)

( * ) Notice: Subject to any disclaimer, the term of this patent is extended or adjusted under 35 U.S.C. 154(b) by 113 days.

(21) Appl. No.: 15/182,183

(22) Filed: Jun. 14, 2016

(65) Prior Publication Data

US 2017/0358276 A1 Dec. 14, 2017

(51) Int. Cl.
*G09G 5/10* (2006.01)
*G09G 5/00* (2006.01)

(52) U.S. Cl.
CPC ..... *G09G 5/10* (2013.01); *G09G 5/003* (2013.01); *G09G 2320/0613* (2013.01); *G09G 2320/0626* (2013.01); *G09G 2320/08* (2013.01); *G09G 2354/00* (2013.01); *G09G 2356/00* (2013.01); *G09G 2370/22* (2013.01)

(58) Field of Classification Search
None
See application file for complete search history.

(56) References Cited

U.S. PATENT DOCUMENTS 9,860,365 B2 * 1/2018 Hadatsuki ..... H04M 1/72569
2004/0176031 A1 * 9/2004 Haller ..... H04M 1/7253 455/41.2
2014/0094158 A1 * 4/2014 Maeda ..... H04W 8/22 455/418
2014/0244198 A1 * 8/2014 Mayer ..... G01N 33/0006 702/104
2014/0337607 A1 * 11/2014 Peterson ..... G06F 9/4401 713/1
2015/0253573 A1 * 9/2015 Sako ..... G02B 27/0172 345/156
2015/0277540 A1 * 10/2015 Jackson ..... G06F 1/3265 345/169
2015/0381689 A1 * 12/2015 Ganesh ..... G06Q 30/0261 705/14.58
2016/0132776 A1 * 5/2016 Yang ..... G06Q 30/02 706/46
2017/0068447 A1 * 3/2017 Hong ..... G06F 3/04817
2017/0079118 A1 * 3/2017 Chen ..... G06F 3/013

FOREIGN PATENT DOCUMENTS

WO WO-2015183259 A1 * 12/2015 ..... G06F 9/06

* cited by examiner

*Primary Examiner* — Andrew G Yang

(74) *Attorney, Agent, or Firm* — Kunzler Bean & Adamson

(57) ABSTRACT

Apparatuses, systems, methods, and computer program products are disclosed for adjusting brightness settings based on proximity and context data. A proximity module determines a proximity of a first information handling device to a second information handling device. A context module determines context data associated with one or more of the second information handling device and a user of the second information handling device. An adjustment module adjusts a brightness setting of the first information handling device based on the determined proximity and the context data.

14 Claims, 5 Drawing Sheets

ADJUSTING BRIGHTNESS SETTINGS BASED ON CONTEXT DATA

FIELD

The subject matter disclosed herein relates to device brightness settings and more particularly relates to adjusting device brightness settings based on a proximity to a different device.

BACKGROUND

Devices such as smart phones and tablet computers may allow a user to control different levels of brightness of a device display or other lights on a device. However, the brightness of a device's display or other lights on a device may interrupt or affect others at inappropriate times, e.g., while someone is sleeping, watching a movie, reading, or the like.

BRIEF SUMMARY

An apparatus for adjusting brightness settings based on proximity and context data is disclosed. A method and computer program product also perform the functions of the apparatus. In one embodiment, an apparatus includes a first information handling device that includes a processor and a memory that stores code executable by the processor. The code, in one embodiment, is executable by a processor to determine a proximity of the first information handling device to a second information handling device.

The code, in a further embodiment, is executable by a processor to determine context data associated with one or more of the second information handling device and a user of the second information handling device. In some embodiments, the code is executable by a processor to adjust a brightness setting of the first information handling device based on the determined proximity and the context data.

The code, in certain embodiments, is further executable by a processor to determine, from the context data, the user's activity state. The context data may include one or more of biological data, calendar data, and location data associated with the user. In one embodiment, the code adjusts the brightness setting by decreasing a brightness level below a predetermined brightness level in response to determining that the user's activity state is a quiet state.

In one embodiment, the predetermined brightness level is determined as a function of the determined proximity of the first information handling device to the second information handling device. In certain embodiments, the code is further executable by the processor to receive different context data from the second information handling device in response to determining a change in the user's activity state and adjust the brightness setting as a function of the user's changed activity state.

In some embodiments, the second information handling device is one of a plurality of second information handling devices. The code may adjust the brightness setting based on the proximity data associated with each second information handling device in response to a number of the plurality of second information handling devices satisfying a device threshold.

In certain embodiments, the code is further executable by the processor to determine a location of one or more of the first information handling device and the second information handling device based on the context data. The context data may include location data indicating a location of one or more of the first information handling device and the second information handling device such that the brightness setting is adjusted based on the indicated location.

In various embodiments, the code is further executable by the processor to determine a relative position of the first information handling device based on the context data. The context data may include position data indicating a relative position of the first information handling device, wherein the brightness setting is adjusted based on the relative position.

In some embodiments, the code is further executable by a processor to determine a different proximity to an information handling device in response to detecting a change in a determined proximity, and adjust a brightness setting as a function of the different proximity.

In certain embodiments, the code is further executable by the processor to adjust the brightness setting in response to determining that the second information handling device is authorized to affect a brightness setting on the first information handling device. The context data may include an identifier for the second information handling device. In certain embodiments, the code is further executable by the processor to notify a user of the first information handling device that the brightness setting has been changed in response to the brightness setting being adjusted.

In some embodiments, the proximity of the first information handling device to the second information handling device is determined using one or more sensors, the one or more sensors selected from the group consisting of a Bluetooth® communication sensor, a signal strength sensor, a location sensor, an altimeter, and a proximity sensor. In one embodiment, the brightness setting is associated with one or more of a display of the first information handling device and one or more lights on the first information handling device.

A method, in one embodiment, includes determining, by use of a processor, a proximity of a first information handling device to a second information handling device. A method, in a further embodiment, includes determining context data associated with one or more of the second information handling device and a user of the second information handling device. In some embodiments, a method includes adjusting a brightness setting of the first information handling device based on the determined proximity and the context data.

A method, in one embodiment, includes determining, from the context data, the user's activity state. The context data may include one or more of biological data, calendar data, and location data associated with the user. In some embodiments, the brightness setting is adjusted by decreasing a brightness level below a predetermined brightness level in response to determining that the user's activity state is a quiet state. The predetermined brightness level may be determined as a function of the determined proximity of the first information handling device to the second information handling device.

In one embodiment, a method includes determining a location of one or more of the first information handling device and the second information handling device based on the context data. The context data may include location data indicating a location of one or more of the first information handling device and the second information handling device. The brightness setting may be adjusted based on the indicated location.

In some embodiments, the method includes determining a relative position of the first information handling device based on the context data. The context data may include position data indicating a relative position of the first information handling device. The brightness setting may be adjusted based on the relative position.

In one embodiment, the brightness setting is adjusted in response to determining that the second information handling device is authorized to affect a brightness setting on the first information handling device. The context data may include an identifier for the second information handling device.

In one embodiment, a program product includes a computer readable storage medium that stores code executable by a processor. In one embodiment, the executable code includes code to perform determining a proximity of a first information handling device to a second information handling device. In a further embodiment, the executable code includes code to determining context data associated with one or more of the second information handling device and a user of the second information handling device. In some embodiments, the executable code includes code to perform adjusting a brightness setting of the first information handling device based on the determined proximity and the context data.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1:
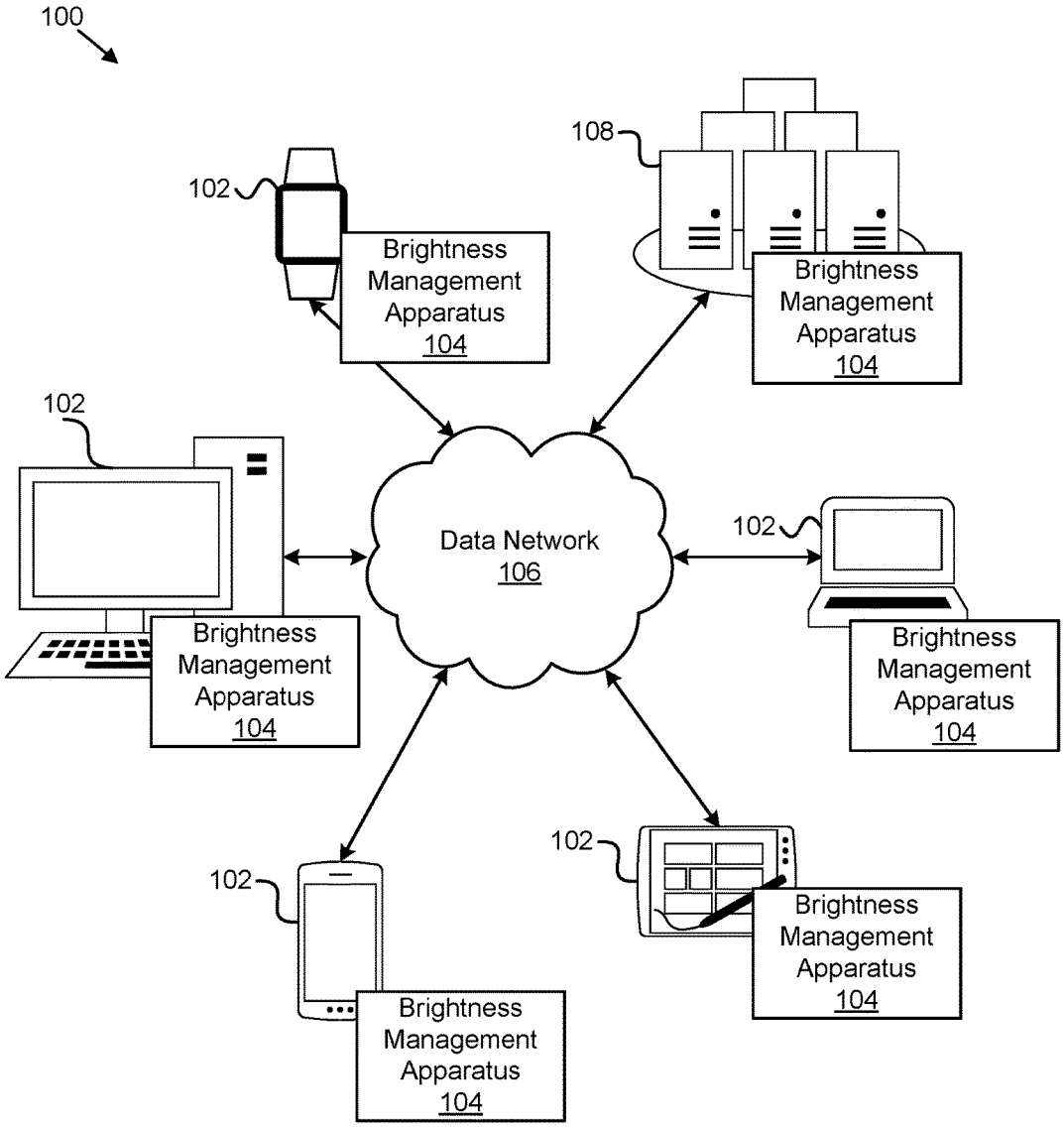
FIG. 1 is a schematic block diagram illustrating one embodiment of a system for adjusting brightness settings based on context data.

As will be appreciated by one skilled in the art, aspects of the embodiments may be embodied as a system, method or program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a program product embodied in one or more computer readable storage devices storing machine readable code, computer readable code, and/or program code, referred hereafter as code. The storage devices may be tangible, non-transitory, and/or non-transmission. The storage devices may not embody signals. In a certain embodiment, the storage devices only employ signals for accessing code.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in code and/or software for execution by various types of processors. An identified module of code may, for instance, comprise one or more physical or logical blocks of executable code which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different computer readable storage devices. Where a module or portions of a module are implemented in software, the software portions are stored on one or more computer readable storage devices.

Any combination of one or more computer readable medium may be utilized. The computer readable medium may be a computer readable storage medium. The computer readable storage medium may be a storage device storing the code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Code for carrying out operations for embodiments may be written in any combination of one or more programming languages including an object oriented programming language such as Python, Ruby, Java, Smalltalk, C++, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and program products according to embodiments. It will be understood that each block of the schematic flowchart diagrams and/or schematic block diagrams, and combinations of blocks in the schematic flowchart diagrams and/or schematic block diagrams, can be implemented by code. These code may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The code may also be stored in a storage device that can direct a computer, other programmable data processing apparatus, or other devices to function in a particular manner, such that the instructions stored in the storage device produce an article of manufacture including instructions which implement the function/act specified in the schematic flowchart diagrams and/or schematic block diagrams block or blocks.

The code may also be loaded onto a computer, other programmable data processing apparatus, or other devices to cause a series of operational steps to be performed on the computer, other programmable apparatus or other devices to produce a computer implemented process such that the code which execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and program products according to various embodiments. In this regard, each block in the schematic flowchart diagrams and/or schematic block diagrams may represent a module, segment, or portion of code, which comprises one or more executable instructions of the code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and code.

The description of elements in each figure may refer to elements of proceeding figures. Like numbers refer to like elements in all figures, including alternate embodiments of like elements.

FIG. 1 is a schematic block diagram illustrating one embodiment of a system 100 for adjusting brightness settings based on context data. In one embodiment, the system 100 includes one or more information handling devices 102, one or more brightness management modules 104, one or more data networks 106, and one or more servers 108. In certain embodiments, even though a specific number of information handling devices 102, brightness management modules 104, data networks 106, and servers 108 are depicted in FIG. 1, one of skill in the art will recognize, in light of this disclosure, that any number of information handling devices 102, brightness management modules 104, data networks 106, and servers 108 may be included in the system 100 for proximity-based brightness adjustment.

In one embodiment, the system 100 includes one or more information handling devices 102. The information handling devices 102 may include one or more of a desktop computer, a laptop computer, a tablet computer, a smart phone, a set-top box, a gaming console, a smart TV, a smart watch, a fitness band or other wearable activity tracking device, an optical head-mounted display (e.g., a virtual reality headset, smart glasses, or the like), a High-Definition Multimedia Interface ("HDMI") or other electronic display dongle, a personal digital assistant, or another computing device comprising a processor (e.g., a central processing unit ("CPU"), a processor core, a field programmable gate array ("FPGA") or other programmable logic, an application specific integrated circuit ("ASIC"), a controller, a microcontroller, and/or another semiconductor integrated circuit device), a volatile memory, and/or a non-volatile storage medium.

In certain embodiments, the information handling devices 102 are communicatively coupled to one or more other information handling devices 102 and/or to one or more servers 108 over a data network 106, described below. The information handling devices 102, in a further embodiment, are configured to execute various programs, program code, applications, instructions, functions, and/or the like, which may access, store, download, upload, and/or the like data located on one or more servers 108.

In one embodiment, the brightness management apparatus 104 is configured to adjust a brightness setting of an information handling device 102 (e.g., a target device) based on a proximity to one or more different information handling devices 102 (e.g., trigger devices) context data associated with a target device, a trigger device, and/or a user. In one embodiment, the brightness management apparatus 104 determines a proximity of a target device to another information handling device 102, e.g., a trigger device. In a further embodiment, the brightness management apparatus 104 determines context data associated with the trigger device and/or a user of the trigger device. The brightness management apparatus 104, in a further embodiment, adjusts a brightness setting of the target device as a function of the determined proximity to the detected information handling device 102 and/or the context data. The brightness management apparatus 104, including its various sub-modules 202-312, may be located on one or more information handling devices 102 in the system 100, one or more servers 108, one or more network devices, and/or the like. The brightness management apparatus 104 is described in more detail below with reference to FIGS. 2 and 3.

In one embodiment, the brightness management apparatus 104 improves the functionality and/or usability of the computer, computing technology, computing environment, or the like, by automatically adjusting a brightness setting of a device, such as a brightness setting of a device display, a light on the device (e.g., an LED, a camera flash, a flashlight, or the like), and/or the like based on context data associated with the device, one or more other devices, one or more user's, or the like, without user intervention.

In various embodiments, the brightness management apparatus 104 may be embodied as a hardware appliance that can be installed or deployed on an information handling device 102, on a server 108, or elsewhere on the data network 106. In certain embodiments, the brightness management apparatus 104 may include a hardware device such as a secure hardware dongle or other hardware appliance device (e.g., a set-top box, a network appliance, or the like) that attaches to a device such as a laptop computer, a server 108, a tablet computer, a smart phone, or the like, either by a wired connection (e.g., a universal serial bus ("USB") connection) or a wireless connection (e.g., Bluetooth®, Wi-Fi, near-field communication ("NFC"), or the like); that attaches to an electronic display device (e.g., a television or monitor using an HDMI port, a DisplayPort port, a Mini DisplayPort port, VGA port, DVI port, or the like); and/or the like. A hardware appliance of the brightness management apparatus 104 may include a power interface, a wired and/or wireless network interface, a graphical interface that attaches to a display, and/or a semiconductor integrated circuit device as described below, configured to perform the functions described herein with regard to the brightness management apparatus 104.

The brightness management apparatus 104, in such an embodiment, may include a semiconductor integrated circuit device (e.g., one or more chips, die, or other discrete logic hardware), or the like, such as a field-programmable gate array ("FPGA") or other programmable logic, firmware for an FPGA or other programmable logic, microcode for execution on a microcontroller, an application-specific integrated circuit ("ASIC"), a processor, a processor core, or the like. In one embodiment, the brightness management apparatus 104 may be mounted on a printed circuit board with one or more electrical lines or connections (e.g., to volatile memory, a non-volatile storage medium, a network interface, a peripheral device, a graphical/display interface, or the like). The hardware appliance may include one or more pins, pads, or other electrical connections configured to send and receive data (e.g., in communication with one or more electrical lines of a printed circuit board or the like), and one or more hardware circuits and/or other electrical circuits configured to perform various functions of the brightness management apparatus 104.

The semiconductor integrated circuit device or other hardware appliance of the brightness management apparatus 104, in certain embodiments, includes and/or is communicatively coupled to one or more volatile memory media, which may include but is not limited to random access memory ("RAM"), dynamic RAM ("DRAM"), cache, or the like. In one embodiment, the semiconductor integrated circuit device or other hardware appliance of the brightness management apparatus 104 includes and/or is communicatively coupled to one or more non-volatile memory media, which may include but is not limited to: NAND flash memory, NOR flash memory, nano random access memory (nano RAM or NRAM), nanocrystal wire-based memory, silicon-oxide based sub-10 nanometer process memory, graphene memory, Silicon-Oxide-Nitride-Oxide-Silicon ("SONOS"), resistive RAM ("RRAM"), programmable metallization cell ("PMC"), conductive-bridging RAM ("CBRAM"), magneto-resistive RAM ("MRAM"), dynamic RAM ("DRAM"), phase change RAM ("PRAM" or "PCM"), magnetic storage media (e.g., hard disk, tape), optical storage media, or the like.

The data network 106, in one embodiment, includes a digital communication network that transmits digital communications. The data network 106 may include a wireless network, such as a wireless cellular network, a local wireless network, such as a Wi-Fi network, a Bluetooth® network, a near-field communication ("NFC") network, an ad hoc network, and/or the like. The data network 106 may include a wide area network ("WAN"), a storage area network ("SAN"), a local area network (LAN), an optical fiber network, the internet, or other digital communication network. The data network 106 may include two or more networks. The data network 106 may include one or more servers, routers, switches, and/or other networking equipment. The data network 106 may also include one or more computer readable storage media, such as a hard disk drive, an optical drive, non-volatile memory, RAM, or the like.

The one or more servers 108, in one embodiment, may be embodied as blade servers, mainframe servers, tower servers, rack servers, and/or the like. The one or more servers 108 may be configured as a mail server, a web server, an application server, an FTP server, a media server, a data server, a web server, a file server, a virtual server, and/or the like. The one or more servers 108 may be communicatively coupled (e.g., networked) over a data network 106 to one or more information handling devices 102. The one or more servers 108 may store data associated with an information handling device, with a user, and/or the like. For example, a server 108 may store location data for an information handling device 102, activity data for a user, calendar/schedule data, biometric data, positional data, and/or other context data associated with an information handling device 102 and/or a user.

Figure 2:
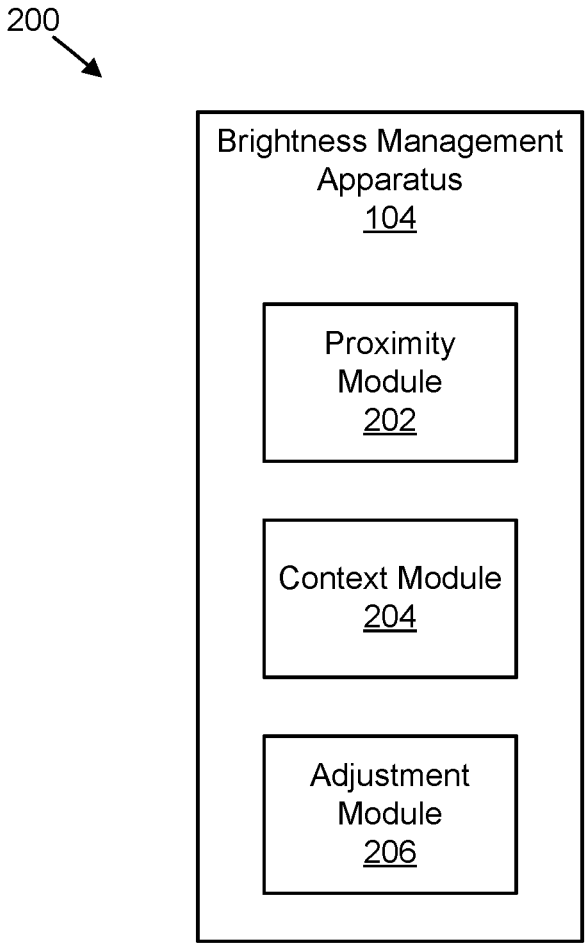
FIG. 2 is a schematic block diagram illustrating one embodiment of an apparatus for adjusting brightness settings based on context data.

FIG. 2 is a schematic block diagram illustrating one embodiment of an apparatus 200 for adjusting brightness settings based on context data. In one embodiment, the apparatus 200 includes an embodiments of a brightness management apparatus 104. The brightness management apparatus 104, in some embodiments, includes one or more of a proximity module 202, a context module 204, and an adjustment module 206, which are described in more detail below.

In one embodiment, the proximity module 202 is configured to determine a proximity of a target device to another information handling device 102, e.g., a trigger device. In certain embodiments, the proximity module 202 determines a proximity to a trigger device in response to detecting the trigger device. The proximity module 202, for example, may detect a wireless signal emitted from the trigger device such as a Bluetooth® signal, an NFC signal, a Wi-Fi signal, a radio signal, or the like. In one embodiment, the proximity module 202 detects a trigger device is within a proximity of a target device based on data received from one or more sensors such as proximity sensors, motion sensors, infrared sensors, short range wireless communication sensors (e.g., Bluetooth®, NFC, Wi-Fi, radio, and/or the like), wireless signal strength sensors, location sensors (e.g., global positioning system ("GPS") sensors), and/or the like. For example, the proximity module 202 may detect that a smart phone, e.g., the trigger device, is within a short range wireless communication proximity of another smart phone, e.g., the target device, based on data received from a Bluetooth® sensor on the target device that is communicatively coupled to the proximity module 202.

The proximity module 202 may determine the distance to the trigger device based on a detected signal strength using signal sensors, a Bluetooth® or other short-range wireless communication distance detection method, data from a location service, a wireless triangulation method, sound sensors, light sensors, and/or the like. For example, if the proximity module 202 is located on a user's smart phone, the proximity module 202 may detect a wireless fitness band of another user by detecting a Bluetooth® signal emitted by the wireless fitness band. Furthermore, the proximity module 202 may use the detected Bluetooth® signal to determine a distance between the smart phone and the wireless fitness band. If both the smart phone and the wireless fitness band include location sensors, such as a GPS sensor, the proximity module 202 may determine the location of both devices and derive a distance between the devices based on their detected locations.

In one embodiment, the proximity module 202 determines a vertical location of a target device and/or a trigger device based on data collected by one or more sensors, such as an altimeter, by a Wi-Fi access point connected to an information handling device 102, by a wireless triangulation location method, and/or the like. For example, the proximity module 202 may determine that a tablet computer is located in a basement bedroom and that a laptop computer is located in a $2^{nd}$ floor bedroom of a house based on altimeter data and/or by determining that the devices are connected to different wireless access points in the house—the tablet computer connected to the basement access point and the laptop computer connected to the $2^{nd}$ floor access point. Based on the vertical location data, the proximity module 202 may determine how "proximate" the target and trigger devices are to each other if they are located on different floors.

The context module 204, in one embodiment, is configured to determine context data associated with a detected information handling device 102, e.g., the trigger device and/or a user of the trigger device. The context data, as used herein, may include data that describes one or more attributes, characteristics, states, or features of a target device, a trigger device, a user, or the like.

In certain embodiments, the context data may include biometric data, which may indicate an activity state of a user of the trigger device, e.g., a quiet state, an awake state, an active state, a sleeping state, and/or the like. For example, the context data may indicate whether the user is awake, is falling asleep, is asleep, is exercising, is sitting, and/or the like, calendar/schedule data, location data, data from one or more sensors such as accelerometers, vibration sensors, and/or the like that may indicate a user's activity, and/or the like.

For example, the context module 204 may receive biometric data from a wireless activity tracker worn by a user that indicates that the user is asleep. In another example, the context module 204 may receive accelerometer data from a user's smart phone that indicates the user is walking around. In a further example, the context module 204 may receive schedule data for a user from the user's tablet computer that indicates the user is attending a currently scheduled meeting.

In a further embodiment, the context data includes location data for the target and/or trigger device (e.g., as determined using GPS sensors, as based on a Wi-Fi access point a device is connected to, as determined based on a relative location to another device, or the like), position data for the target device, identification data for the trigger device (e.g., an IP address, a MAC address, a device identifier, a name or username of a user associated with the device, and/or the like), and/or the like. For example, the context module 204 may receive position data that indicates the target device is being held facing the user, away from the user, or the like. In another example, the context module 204 may receive context data that indicates that the target device is located on a certain floor of a house, in a certain room of a house, at a particular GPS location, at a restaurant, at a movie theatre, or the like.

In one embodiment, the adjustment module 206 is configured to adjust one or more brightness levels or settings of an information handling device 102, e.g., the target device, as a function of the determined proximity of another information handling device 102, e.g., the trigger device, and the context data. The adjustment module 206, for example, may adjust (e.g., make brighter or dimmer) a brightness of a target device's display or a brightness of a light on the target device (e.g., a flash or flashlight), as a function of the proximity data and the context data.

In certain embodiments, the adjustment module 206 decreases a brightness level below a predetermined brightness level in response to determining that the user's activity state is a quiet state. For example, a user may walk into his bedroom with his smart phone. A proximity module 202 located on or associated with the smart phone may detect that a fitness tracker (e.g., a Fitbit®) being worn by the user's wife is within a proximity of the user's smart phone. The proximity module 202 may also determine that the user's smart phone is within five feet of the wife's fitness tracker. The context module 204 may request and/or receive context data from the fitness tracker that indicates an activity state of the user. In this example, the context data may include biometric data that indicates the wife is asleep such as the wife's heart rate data, breathing pattern data, or the like.

Continuing with the above example, the adjustment module 206 may adjust one or more brightness settings on the user's smart phone as a function of the proximity of the smart phone to the fitness tracker and determining that the wife is asleep. In this example, the adjustment module 206 may dim a flashlight that has been activated on the device so that it is not bright enough to disturb the wife in response to the context data indicating that the wife is asleep and that the determined distance between the devices is only five feet. In this manner, the brightness management apparatus 104 may control the brightness of a target device based on activities of other users as determined by the context data collected by the other users' devices and the proximity to the other users' devices (e.g., the trigger devices).

In certain embodiments, the adjustment module 206 adjusts a brightness level of a target device based on a type of application executing on the target device. In certain embodiments, the adjustment module 206 adjusts a display brightness differently for a video application, a game application, a web browser, an e-reader application, a social networking application, a flashlight application, or the like. For example, the adjustment module 206 may dim a light used for a flashlight application on a smart phone to a greater degree than the smart phone's display when used to watch videos.

In some embodiments, the adjustment module 206 adjusts a brightness setting of a target device based on context data associated with a plurality of different trigger devices that are within a communication proximity of the target device. For example, the proximity module 202 may detect a plurality of devices within a communication proximity of the target device. Accordingly, the adjustment module 206 may dim the brightness of the target device's display because the target device is likely in a public place. In some embodiments, the adjustment module 206 adjusts the brightness settings in response to the number of devices within a proximity of the target device satisfying a device threshold.

For example, if the target device is in a movie theater, and there is only one other device detected in the movie theater (or a number of devices less than the device threshold), the adjustment module 206 may not adjust the brightness settings very much, if at all. On the other hand, if the number of devices within a proximity of the target device satisfies a device threshold of ten, for example, the adjustment module 206 may adjust the brightness settings accordingly. The amount of adjustment applied by the adjustment module 206 may correspond to the number of devices that are detected within a proximity of the target device. In other words, as the number of devices within a proximity of the target device increase, the amount that the brightness is adjusted (e.g., decreased) increases.

Furthermore, the context data may include location data for the target device as determined by the location module 310, described below, that indicates the target device is at a movie theater. The adjustment module 206, in such an embodiment, may use the proximity data and the location data to determine whether to dim the brightness of the device's display, and to what extent to dim the display.

In one embodiment, as described above, the adjustment module 206 may decrease a brightness level of an information handling device 102 below a predetermined or threshold brightness level. The predetermined brightness level may be set based on the determined proximity to a trigger device. In other words, the adjustment module 206 may continuously reduce a brightness setting as a target device approaches a trigger device that also indicates the user is in a quiet state. For example, if a user is sleeping, the adjustment module 206 of a smart phone approaching the sleeping user's device may reduce the smart phone's brightness settings, and continue to reduce the brightness settings, as the smart phone is brought within a closer proximity of the sleeping user's device.

On the other hand, in certain embodiments, the adjustment module 206 resets the brightness settings of a target device in response to the proximity module 202 determining that the target device is not within a proximity of a trigger device (e.g., if a user holding the target device walks away from the trigger device); in response to the context module 204 receiving context data that indicates another user is no longer in a quiet state; and/or the like. For example, the adjustment module 206 may reset a phone's display brightness level to a previous setting in response to determining that another user woke up based on biometric data received by the context module 204 from the awakened user's wearable fitness tracker.

In one embodiment, the adjustment module 206 adjusts a brightness setting of a device when the proximity module 202 determines that the target device is within a threshold proximity of a trigger device or when the context module 204 determines that an activity state of a user of the trigger device has changed to a quiet state. In some embodiments, the adjustment module 206 does not adjust the brightness setting of a target device until the target device receives or detects an event that causes the display or another light of the target device to turn on. For example, the adjustment module 206 may not adjust a phone's display brightness level until a phone call or other notification is received and presented on the phone's display. In other words, the adjustment module 206 may adjust brightness settings of a target device on an "as needed" basis.

In some embodiments, the proximity module 202 determines a different or new proximity to a trigger device in response to detecting a change in a previously determined proximity. In such an embodiment, the proximity module 202 may periodically check or poll a target device's proximity in relation to a previously detected trigger device. If a previously determined proximity is different than a currently determined proximity, then the proximity module 202 may determine the new proximity to the trigger device, e.g., the distance between the proximity module 202, or a target device where the proximity module 202 is located, and the trigger device. The adjustment module 206 may then adjust one or more brightness settings of the target device as a function of the different proximity, e.g., the adjustment module 206 may increase or reset the brightness level of the target device's display if the distance between the target device and the trigger device is greater than a previously determined distance or decrease the brightness level of the target device's display if the distance between the target device and the trigger device is less than a previously determined distance.

In certain embodiments, the context module 204 receives new context data associated with the target device, the trigger device, and/or a user. In such an embodiment, the context module 204 may periodically request and/or receive context data from the trigger device to determine one or more characteristics, states, features, or the like of the trigger device and/or a user associated with the trigger device, e.g., whether the activity state of the user has changed. For example, if the activity state of the user has changed, e.g., from a quiet state to an active state, or vice versa, the adjustment module 206 may adjust one or more brightness settings of the target device as a function of the new activity state, e.g., the adjustment module 206 may increase or reset the brightness settings of the target device if the activity state of another user, as indicated by the context data, changes from a quiet state to an active state, or decrease the brightness settings of the target device if the activity state of the other user changes from an active state to a quiet state.

Figure 3:
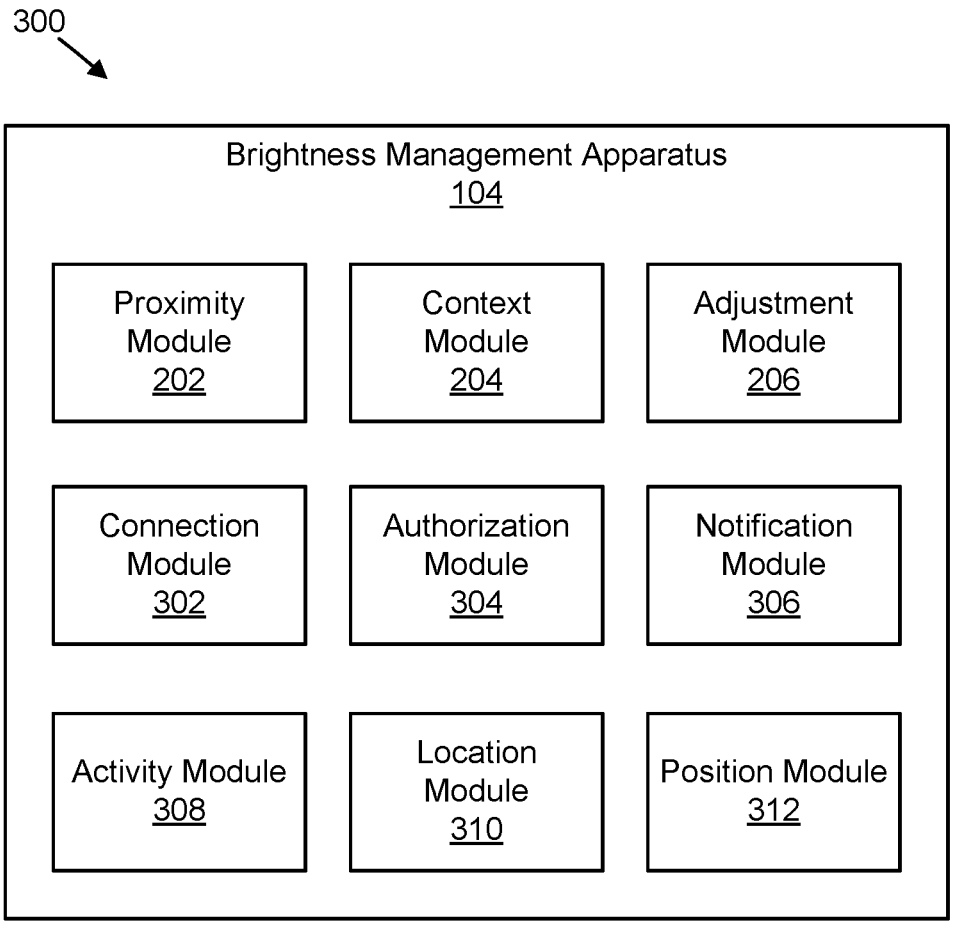
FIG. 3 is a schematic block diagram illustrating one embodiment of another apparatus for adjusting brightness settings based on context data.

FIG. 3 is a schematic block diagram illustrating one embodiment of an apparatus 300 for adjusting brightness settings based on context data. In one embodiment, the apparatus 300 includes an embodiment of a brightness management apparatus 104. In certain embodiments, the brightness management apparatus 104 includes one or more of a proximity module 202, a context module 204, and an adjustment module 206, which may be substantially similar to the proximity module 202, the context module 204, and the adjustment module 206 described above with reference to FIG. 2. Furthermore, the brightness management apparatus 104 may include one or more of a connection module 302, an authorization module 304, a notification module 306, an activity module 308, a location module 310, and a position module 312, which are described in more detail below.

The connection module 302, in one embodiment, is configured to communicatively couple the target device to the detected trigger device. In certain embodiments, the connection module 302 connects to the trigger device using a short-range wireless communication protocol such as a Bluetooth® protocol, an NFC communication protocol, an infrared protocol, a Wi-Fi protocol, a radio protocol, and/or the like. For example, in response to the proximity module 202 detecting a laptop within a close proximity of a user's smart phone, the connection module 302 may select a communication protocol that is compatible with both devices to initiate communication with the laptop. After communication is established, the context module 204 may request context data from the laptop including user data, schedule data, location data, identification data, and/or the like.

In one embodiment, the authorization module 304 is configured to determine whether a detected trigger device is a device that is authorized to communicate with the target device. The authorization module 304, in some embodiments, maintains a listing of preselected, predetermined, authorized, registered, and/or the like trigger devices that are allowed to communicate with the target device. In such an embodiment, the authorization module 304 may identify an authorized trigger device using an identifier for the trigger device such as an IP address, a MAC address, a device name, and/or the like.

The authorization module 304, in some embodiments, registers a trigger device as an authorized device in response to user input. For example, a user may provide a device identifier for a wearable fitness tracker to the authorization module 304 to register the wearable fitness tracker as an authorized device, which may allow the user to "opt-in" to allowing the wearable fitness tracker, or a user's activity detected by the wearable fitness tracker, to control the brightness on the user's device. In certain embodiments, a trigger device may request permission to communicate with the target device in response to the target device detecting the trigger device. For example, the authorization module 304 may receive a request over a Bluetooth® connection with a trigger device requesting permission to send context data and/or other types of data to the target device.

In one embodiment, the notification module 306 is configured to notify a user that a brightness setting on the target device has been adjusted after the adjustment module 206 adjusts the brightness setting. For example, the notification module 306 may present a notification on a user's smart phone to indicate that the brightness setting for the target device's display has been decreased because the smart phone is within a threshold proximity of the user's sleeping spouse, as determined based on the context data received from the user's spouse's fitness band. Similarly, the notification module 306 may maintain a log, a history, and/or the like of instances when the adjustment module 206 adjusted the brightness settings of a target device, including which settings were adjusted, when the settings were adjusted, why the settings were adjusted, and/or the like.

The activity module 308, in one embodiment, is configured to determine, from the context data, an activity state of the user. As used herein, a user's activity state may describe a level or state of activity for a user, such as active, quiet, sleeping, awake, exercising, driving, busy, available, or the like. In certain embodiments, as described above, the context module 204 may receive activity data as part of the context data associated with the trigger device and/or the trigger device's user. The activity data may include biometric data, calendar data, or the like that indicates an activity state of a user.

For example, the context module 204 may receive biometric data from a user's fitness band that indicates the user is sleeping, is waking up, or is otherwise in a quiet or active state. Accordingly, based on the activity data, the adjustment module 206 may adjust a brightness setting for the target device. For example, the adjustment module 206 may decrease the brightness level for a target device's display in response to determining that a user within a proximity of the target device is sleeping (as determined based on activity data received from a fitness band, or the like, associated with the user).

In certain embodiments, the context module 204 determines different activity data a user in response to determining a change in the user's activity state. For example, the activity module 308 may periodically poll the trigger device for a user's activity state and to determine whether the user's activity state has changed. If so, the context module 204 may receive new activity data from the trigger device, and the adjustment module 206 may adjust the brightness settings of the target device accordingly.

The location module 310, in one embodiment, is configured to determine a location of the target device, and include the location data as part of the context data for the target device. The location module 310, for example, may use GPS data, data from a mapping service (such as Google Maps®), cellular triangulation data, or the like to determine a device's location. Based on the location data, the adjustment module 206 may adjust one or more brightness settings of a target device.

For example, if the location module 310 determines that a target device is located at a movie theater, the adjustment module 206 may decrease the brightness settings of the target device's display so that if the display is turned on or otherwise activated while in the movie theater, the display brightness may not disturb other patrons in the theater.

The position module 312, in one embodiment, is configured to determine a relative location or position of the target device. The relative position of the target device, for example, may indicate how the target device is being held or otherwise positioned relative to the target device's user, the trigger device, and/or the trigger device's user. The position module 312 may reference data collected from an accelerometer, proximity sensors, capacitance sensors, camera data, and/or the like. Based on the position data, the adjustment module 206 may adjust one or more brightness settings for the target device.

For example, if the position module 312 determines that a target device's display is facing away from the user, based on the position data, the adjustment module 206 may increase the brightness of the device's display (e.g., the user may be using the device as a flashlight). Similarly, the position module 312 may determine whether the target device's display is facing the user, and the adjustment module 206 may adjust the target device's display brightness accordingly (e.g., the adjustment module 206 may increase the display brightness if the user is alone in a hotel room, but decrease the brightness if the user is in a movie theater).

The adjustment module 206, in various embodiments, uses a combination of the proximity data and the various types of context data to determine how and which brightness settings to adjust. For example, if adjustment module 206 determines that the user is alone in a hotel room (as indicated by the proximity module 202 not detecting any devices within a predetermined proximity of the target device, and the location data determined by the location module 310), and determines that the target device's display is facing the user (as indicated by the position module 312), the adjustment module 206 may increase the brightness of the target device's display.

Figure 4:
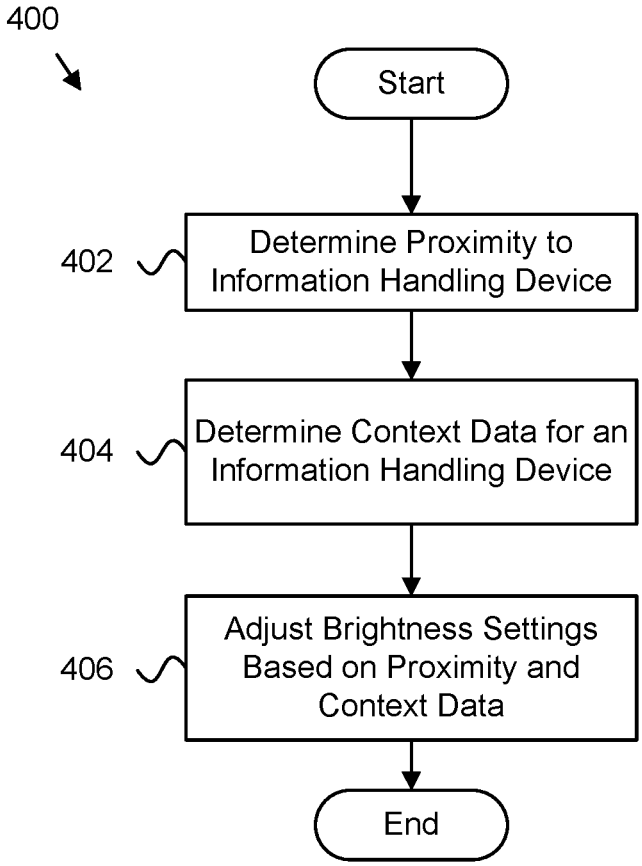
FIG. 4 is a schematic flow chart diagram illustrating one embodiment of a method for adjusting brightness settings based on context data.

FIG. 4 is a schematic flow chart diagram illustrating one embodiment of a method 400 for adjusting brightness settings based on context data. In one embodiment, the method 400 begins, and a proximity module 202 determines 402 a proximity of a target device to another information handling device 102, e.g., a trigger device, in response to detecting the trigger device. In a further embodiment, a context module 204 determines 404 context data for the trigger device, which may include data associated with a user of the trigger device, and context data associated with the target device (e.g., location or position data). In various embodiments, an adjustment module 206 adjusts 406 a brightness setting of a target device as a function of the proximity to the trigger device and the context data, and the method 400 ends.

Figure 5:
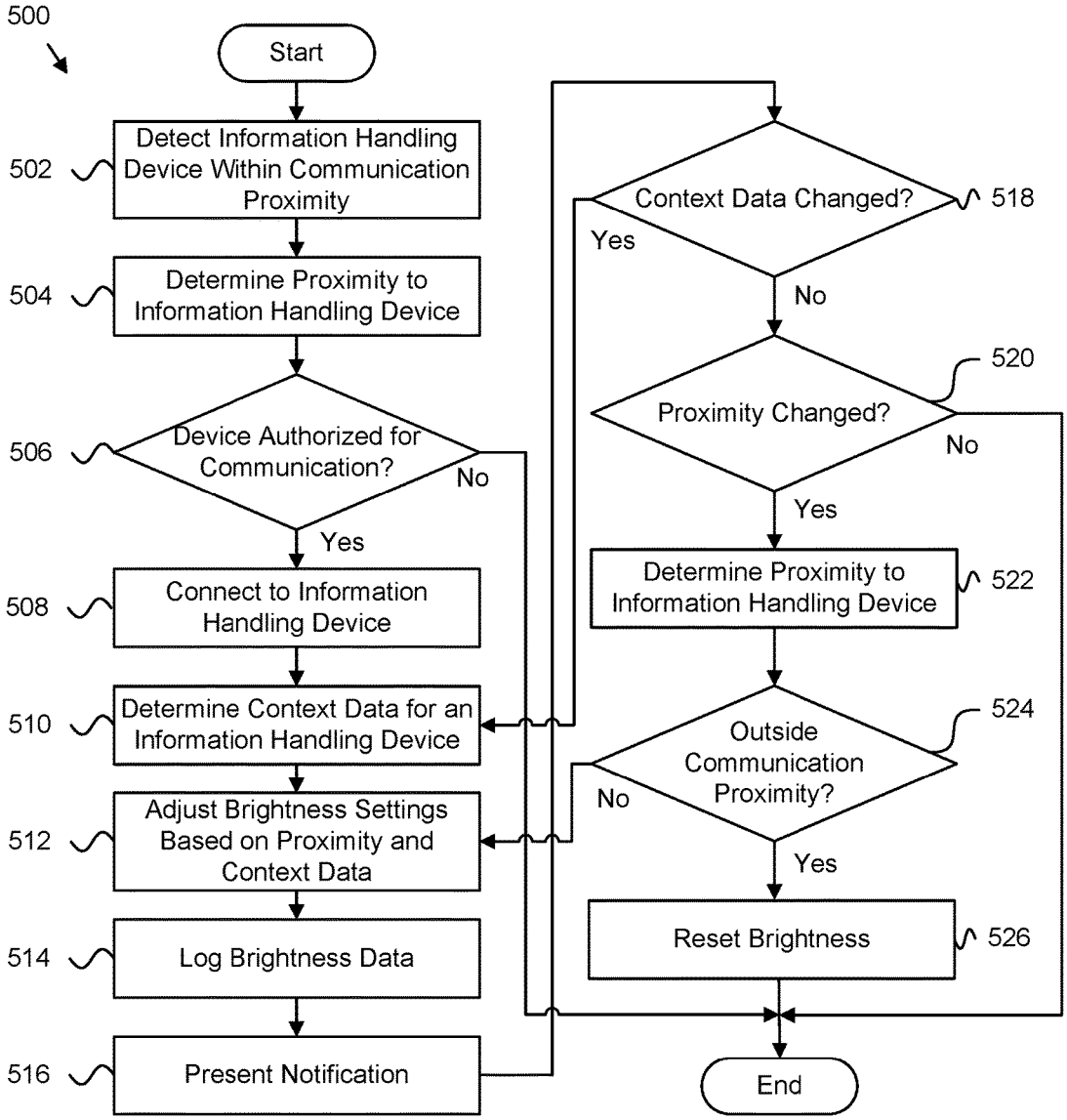
FIG. 5 is a schematic flow chart diagram illustrating one embodiment of another method for adjusting brightness settings based on context data.

FIG. 5 is a schematic flow chart diagram illustrating one embodiment of another method 500 for adjusting brightness settings based on context data. In one embodiment, the method 500 begins, and a proximity module 202 detects 502 a trigger device is within a communication proximity of a target device. In a further embodiment, the proximity module 202 determines 504 a proximity of the target device to the trigger device.

If the authorization module 304, in one embodiment, determines 506 the trigger device is not authorized to communicate with the target device, the method 500 ends. Otherwise, the connection module 302, in one embodiment, connects 508 the target device to the trigger device. In some embodiments, the context module 204 receives 510 context data from the trigger device, which may describe a characteristic, feature, stat (e.g., activity state) or the like of the trigger device and/or the user of the trigger device.

In one embodiment, the adjustment module 206 adjusts 512 one or more brightness settings for the target device based on the determined proximity to the trigger device and the determined context data. In one embodiment, the notification module 306 logs 514 the brightness adjustment details in a log or history associated with the target device. The notification module 306, in a further embodiment, presents 516 a notification to the user on the target device that notifies the user that one or more brightness settings have been changed on the target device and/or reasons why the brightness settings were changed.

In some embodiments, if the context module 204 determines 518 that the context data associated with the trigger device, the target device, and/or a user has changed, the context module 204 determines 510 new context data for the trigger device, the target device, and/or a user, which the adjustment module 206 may use to adjust 512 one or more brightness settings of the target device. Otherwise, if the proximity module 202 determines 520 that proximity of the target device to the trigger device has changed, meaning the distance between the devices has changed, the proximity module 202 determines 522 the new proximity to the trigger device. Otherwise, the method 500 ends.

In one embodiment, if the proximity module 202 determines 524 that the new proximity to the trigger device is not outside a communication proximity, the adjustment module 206 adjusts 512 one or more settings of the target device based on the new proximity. Otherwise, the adjustment module 206 resets 526 one or more adjusted brightness settings of the target device to a previous brightness setting, and the method 500 ends.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a first information handling device comprising a processor;

a memory that stores code executable by the processor to:

determine a location of the first information handling device;

detect a plurality of second information handling devices within a proximity of the first information handling device;

determine the number of second information devices that are within the proximity of the first information handling device;

determine distances between the first information handling device and the plurality of second information handling devices;

determine context data associated with one or more of the second information handling devices and users of the second information handling devices;

determine, from the context data, an activity state of the users of the second information handling devices, the activity state selected from the group consisting of a quiet state, an active state, and a sleeping state; and in response to the determined number of second information handling devices satisfying a threshold number of devices that are within the proximity of the first information handling device, adjust a brightness setting of the first information handling device based on the determined location, the distances between the first and second information handling devices, the number of second information handling devices within the proximity of the first information handling device, and the activity state of the users of the second information handling devices, the brightness setting being adjusted at least in part by an amount that is inversely proportional to the number of second information handling devices that are within a proximity of the first information handling device.

2. The apparatus of claim 1, wherein the context data is selected from the group consisting of biological data, calendar data, and location data associated with the user.

3. The apparatus of claim 2, wherein the code is further executable by the processor to:

receive different context data from the second information handling devices in response to determining a change in the activity state of the users; and adjust the brightness setting as a function of the changed activity state.

4. The apparatus of claim 1, wherein the code is further executable by the processor to determine a relative position of the first information handling device based on the context data, the context data comprising position data indicating a relative position of the first information handling device, wherein the brightness setting is adjusted based on the relative position.

5. The apparatus of claim 1, wherein the code is further executable by the processor to:

determine a different proximity of the first information handling device to the second information handling devices in response to detecting a change in the determined proximity; and adjust the brightness setting as a function of the different proximity.

6. The apparatus of claim 1, wherein the code is further executable by the processor to adjust the brightness setting in response to determining that the second information handling devices are authorized to affect a brightness setting on the first information handling device, the context data comprising an identifier for the second information handling devices.

7. The apparatus of claim 1, wherein the code is further executable by the processor to notify a user of the first information handling device that the brightness setting has been changed in response to the brightness setting being adjusted.

8. The apparatus of claim 1, wherein the proximity of the first information handling device to the second information handling devices is determined using one or more sensors, the one or more sensors selected from the group consisting of a Bluetooth® communication sensor, a signal strength sensor, a location sensor, an altimeter, and a proximity sensor.

9. The apparatus of claim 1, wherein the brightness setting is associated with one or more of a display of the first information handling device and one or more lights on the first information handling device.

10. A method comprising:

determining, by use of a processor, a location of a first information handling device;

detecting a plurality of second information handling devices within a proximity of the first information handling device;

determining the number of second information devices that are within the proximity of the first information handling device;

determining distances between the first information handling device and the plurality of second information handling devices;

determining context data associated with one or more of the second information handling devices and users of the second information handling devices;

determining, from the context data, an activity state of the users of the second information handling devices, the activity state selected from the group consisting of a quiet state, an active state, and a sleeping state; and in response to the determined number of second information handling devices satisfying a threshold number of devices that are within the proximity of the first information handling device, adjusting a brightness setting of the first information handling device based on the determined location, the distances between the first and second information handling devices, the number of second information handling devices within the proximity of the first information handling device, and the activity state of the users of the second information handling devices, the brightness setting being adjusted at least in part by an amount that is inversely proportional to the number of second information handling devices that are within a proximity of the first information handling device.

11. The method of claim 10, wherein the context data comprises one or more of biological data, calendar data, and location data associated with the user.

12. The method of claim 10, further comprising determining a relative position of the first information handling device based on the context data, the context data comprising position data indicating a relative position of the first information handling device, wherein the brightness setting is adjusted based on the relative position.

13. The method of claim 10, wherein the brightness setting is adjusted in response to determining that the second information handling devices are authorized to affect a brightness setting on the first information handling device, the context data comprising an identifier for the second information handling devices.

14. A program product comprising a computer readable storage medium that stores code executable by a processor, the executable code comprising code to perform:

determining a location of a first information handling device;

detecting a plurality of second information handling devices within a proximity of the first information handling device;

determining the number of second information devices that are within the proximity of the first information handling device;

determining distances between the first information handling device and the plurality of second information handling devices;

determining context data associated with one or more of the second information handling devices and users of the second information handling devices;

determining, from the context data, an activity state of the users of the second information handling devices, the activity state selected from the group consisting of a quiet state, an active state, and a sleeping state; and in response to the determined number of second information handling devices satisfying a threshold number of devices that are within the proximity of the first information handling device, adjusting a brightness setting of the first information handling device based on the determined location, the distances between the first and second information handling devices, the number of second information handling devices within the proximity of the first information handling device, and the activity state of the users of the second information handling devices, the brightness setting being adjusted at least in part by an amount that is inversely proportional to the number of second information handling devices that are within a proximity of the first information handling device.

* * * * *